US007341203B1

(12) United States Patent
Yeomans et al.

(10) Patent No.: US 7,341,203 B1
(45) Date of Patent: Mar. 11, 2008

(54) FOUNTAIN DEVICE

(75) Inventors: Michael Yeomans, Adamstown, MD (US); Henk Sterenberg, Silver Spring, MD (US)

(73) Assignee: Aqua Bella Designs, LLC, Harpers Ferry, WV (US)

( * ) Notice: Subject to any disclaimer, the term of this patent is extended or adjusted under 35 U.S.C. 154(b) by 244 days.

(21) Appl. No.: 11/065,049

(22) Filed: Feb. 25, 2005

Related U.S. Application Data

(60) Provisional application No. 60/547,082, filed on Feb. 25, 2004.

(51) Int. Cl.
*F21S 8/00* (2006.01)

(52) U.S. Cl. ..... 239/20; 239/16; 239/17; 239/19; 239/211; 239/23

(58) Field of Classification Search ..... 239/16, 239/21, 20, 23, 17, 19, 211
See application file for complete search history.

(56) References Cited

U.S. PATENT DOCUMENTS

| | | | | |
|---|---|---|---|---|
| 2,974,871 | A * | 3/1961 | Naythons | 239/17 |
| 3,409,223 | A * | 11/1968 | Gosh | 239/12 |
| 3,503,554 | A * | 3/1970 | Clifton | 239/23 |
| 4,070,849 | A | 1/1978 | DiGiacomo | |
| D343,442 | S | 1/1994 | Cooper | |
| 5,933,883 | A | 8/1999 | Biancamano | |
| 5,934,557 | A | 8/1999 | Shih | |
| 6,029,899 | A * | 2/2000 | Walker | 239/17 |
| 6,082,074 | A | 7/2000 | Shaw et al. | |
| D442,669 | S | 5/2001 | Wang | |
| 6,290,844 | B1 | 9/2001 | Tennyson, Jr. | |
| 6,293,198 | B1 | 9/2001 | Mizuno | |
| D454,612 | S | 3/2002 | Chang | |
| D454,613 | S | 3/2002 | Wood | |
| 6,364,276 | B1 | 4/2002 | Polzin et al. | |
| 6,405,937 | B1 | 6/2002 | Stukenberg | |
| 6,416,197 | B1 | 7/2002 | Chang | |
| 6,427,927 | B1 | 8/2002 | Hall | |
| 6,505,782 | B1 * | 1/2003 | Yen | 239/17 |
| 6,530,530 | B1 | 3/2003 | Peterson | |
| D475,116 | S | 5/2003 | Chan | |
| 6,557,777 | B1 | 5/2003 | Pevnick | |
| 6,565,940 | B1 | 5/2003 | Lin | |
| 6,581,349 | B1 | 6/2003 | Riley | |
| 6,599,164 | B1 | 7/2003 | Gerwitz et al. | |
| 6,843,910 | B1 * | 1/2005 | Thomas | 210/167.01 |
| 2003/0098361 | A1 | 5/2003 | Kuykendal et al. | |

* cited by examiner

*Primary Examiner*—Dinh Q. Nguyen
(74) *Attorney, Agent, or Firm*—Edell, Shapiro & Finnan, LLC

(57) ABSTRACT

A fountain device includes a container including a reservoir to hold and retain circulating fluid within the fountain device, where the container includes an opening and a lip extending around at least a peripheral portion of the opening, a pump securable within the container, a cover configured to encompass the opening and engage the lip of the container when the cover is installed on the container, and a discharge hose securable to an outlet of the pump and extendable to an outlet of the container. The cover includes a plurality of apertures that facilitate passage of fluid through the cover to the reservoir of the container. In addition, a kit including all of the above described components of the fountain device is provided, where the components are assembled within the kit to permit easy installation of the fountain device.

18 Claims, 2 Drawing Sheets

FOUNTAIN DEVICE

CROSS REFERENCE TO RELATED APPLICATION

This application claims priority from: U.S. Provisional Patent Application Ser. No. 60/547,082 entitled "Fountain Device" and filed Feb. 25, 2004. The disclosure of this provisional patent application is incorporated herein by reference in its entirety.

BACKGROUND OF THE INVENTION

1. Field of the Invention

The present invention pertains to fountain devices for circulating water and other fluids.

2. Description of the Related Art

Water fountains provide a decorative feature that is desirable in many commercial and residential settings. In particular, outdoor water fountains can enhance the aesthetic features of a particular surrounding. However, outdoor water fountains can be difficult, time-consuming and even expensive to install and maintain, especially in situations where components for the water fountain (e.g., pump, reservoir, etc.) are difficult to find and/or must be obtained separately and integrated together to form the fountain. It would be desirable to provide a kit containing all essential components for a fountain to enable one to install a fountain with relative ease and without significant expense.

SUMMARY OF THE INVENTION

Accordingly, it is an object of the present invention to provide a fountain that is easy to install and maintain.

It is another object of the present invention to provide a kit containing essential fountain components to facilitate easy installation of the fountain.

The aforesaid objects are achieved individually and in combination in accordance with the present invention, and it is not intended that the present invention be construed as requiring two or more of the objects to be combined unless expressly required by the claims attached hereto.

In accordance with the present invention, a fountain device comprises a container including a reservoir to hold and retain circulating fluid within the fountain device, where the container includes an opening and a lip extending around at least a peripheral portion of the opening, a pump securable within the container, a cover configured to encompass the opening and engage the lip of the container when the cover is installed on the container, and a discharge hose securable to an outlet of the pump and extendable to an outlet of the container. The cover includes a removable door that permits removal of the pump from the container and a plurality of apertures that facilitate passage of fluid through the cover to the reservoir of the container.

In another embodiment of the invention, a kit including all of the above described components of the fountain device is provided, where the components are assembled within the kit to permit easy installation of the fountain device.

In a further embodiment of the invention, a method of using a fountain device comprises embedding at least a portion of a container within a support structure for the container, where the container includes a reservoir and is configured to hold and retain fluid circulating within the fountain device, securing a pump within the container, securing a discharge hose to an outlet of the pump and an outlet of the container, and installing a cover over an opening of the container by engaging the cover with a lip extending around at least a peripheral portion of the container, where the cover includes a removable door configured to permit removal of the pump from the container and a plurality of apertures that facilitate passage of fluid through the cover to the reservoir of the container.

The above and still further objects, features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DESCRIPTION OF THE PREFERRED EMBODIMENTS

Figure 1:
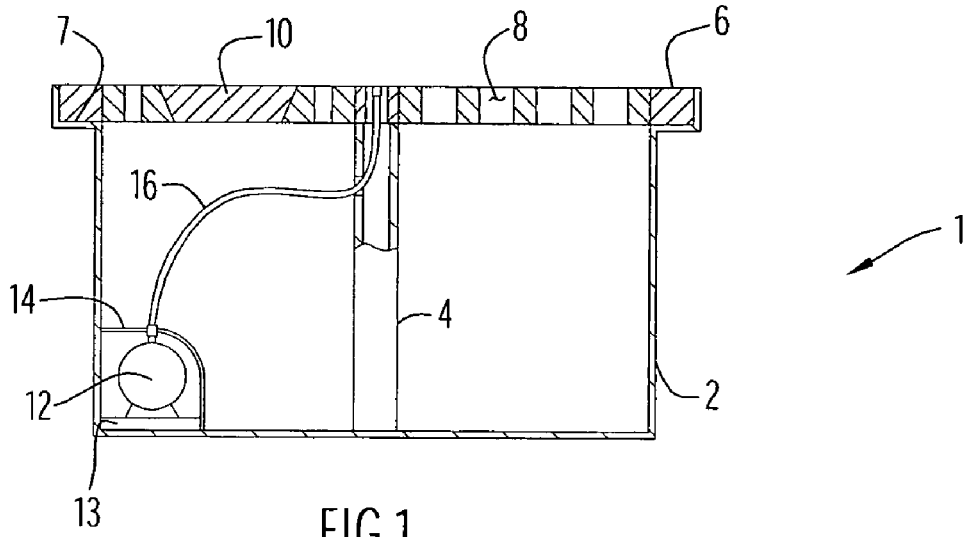
FIG. 1 is a side view in cross-section of the fountain device in accordance with the present invention.
Figure 2:
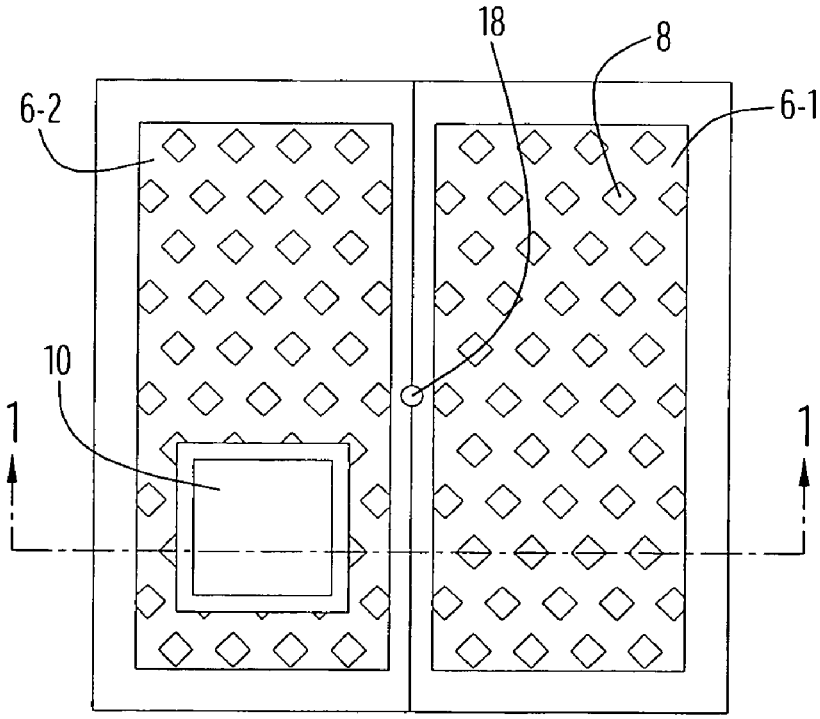
FIG. 2 is a top view in plan of the fountain device of FIG. 1.

An exemplary embodiment of a fountain device is depicted in FIGS. 1 and 2. Specifically, the fountain device 1 includes a generally rectangular reservoir tank or container 2 that is durable and waterproof. Preferably, the container is constructed of a lightweight material (e.g., high density polyethylene or HDPE) that is structurally resistant to temperature fluctuations (e.g., temperature ranges from about −30° F. to about 130° F.) so as to prevent cracking of the container during seasonal temperature changes as well as to facilitate ease of handling during installation of the device. The container is also preferably UV stabilized to prevent degradation caused by exposure to UV rays from the sun. The container 2 includes a hollow interior that is suitably dimensioned to receive other components of the device as well as a sufficient amount of water (or other fluid) to facilitate the circulation of water through a fountain structure during operation of the device as described below. Exemplary dimensions of the container 2 are as follows: the container has a length of about 48 inches, a width of about 48 inches, and a height ranging from about 24 inches to about 30 inches, yielding a volume for the container that is between about 32 to about 40 cubic feet. However, the container is not limited to these dimensions and can have any selected geometric configuration and/or any selected dimensions that are desired for a particular environment in which the device is to be used.

A support column 4 is disposed in a generally central location within the container and extends substantially the height of the container (e.g., about 24 inches to about 30 inches) to provide support for a generally rectangular grate 6 that serves as a cover for the hollow container 2. A selected portion of the support column 4 is hollow (e.g., some sections or the entire length of the support column) to allow a hose to extend through a portion of the support column as described below. The support column 4 and grate 6 can also be constructed of the same materials as the container 2 (e.g., HDPE).

The grate 6 fits within an inner ledge or lip 7 formed along the interior peripheral surfaces of the upper rim of the container 2. The lip can extend around the entire periphery or, alternatively, around a selected one or more peripheral portions of the upper rim of the container. The lip 7 of the container 2 is inset a sufficient distance from the upper edges of the container such that, when the grate 6 rests within the lip, the upper surface of the grate is substantially flush with the upper edges of the container 2 and rests on the top edge of the support column 4. The supporting lip 7 of the container 2 and the support column 4 are of sufficient strength and provide sufficient structural support for the grate 6 to permit the device to carry a large weight load (e.g., at least about 2000 pounds or about 907 kilograms or greater). The grate also has sufficient structural strength to support such weight loads without bending, buckling or breaking.

In addition, the grate 6 can be constructed of a single section or, alternatively, two or more sections, where the one or more sections are supported by the lip 7 as well as the support column 4. For example, the embodiment depicted in FIG. 2 shows two grate sections 6-1 and 6-2 that have the same dimensions. Further, the device can include any suitable number of support columns (e.g., two or more) disposed at any suitable locations to enhance the weight bearing load at any one or more selected locations within the container. Alternatively, the support column can be eliminated from the device, particularly in situations in which the device is not required to bear significant weight loads during its use.

The grate 6 includes a series of apertures 8 disposed at various locations on the grate and extending through the grate between its upper and lower surfaces. Any suitable number of apertures can be provided on the grate in any selected patterns or configurations, and the apertures can be of any suitable dimensions and geometric configurations to facilitate passage of water flowing from the fountain back into the container 2 during operation of the device as described below. In the embodiment of FIGS. 1 and 2, the apertures 8 are rectangular with length and width dimensions of about 1 inch. However, the apertures can have smaller dimensions (e.g., 0.5 inch or smaller) depending upon a particular application.

The grate 6 further includes a generally rectangular trap door 10 that is removable from the grate to facilitate access to the interior of the container 2 at a pump mount location within the container as described below. Preferably, the trap door 10 is disposed proximate a corner of the grate 6 and has a generally trapezoidal cross-sectional configuration such that the top surface of the grate has larger dimensions than the bottom surface of the grate. For example, the trap door can be configured with a generally square top surface having length and width dimensions of about 10 inches and a generally square bottom surface having length and width dimension of about 9 inches, where the peripheral or side surfaces of the trap door extend toward each other from the top surface to the bottom surface at an angle of about 60° (as measured between each side surface and the top surface). The grate 6 includes an opening that complements the geometry of the trap door 10 such that the trap door rests within the grate opening generally flush with the top surface of the grate and is easily removable from the grate. The trap door can include any suitable grasping mechanism, such as a key hole or a protrusion, to facilitate grasping and removal of the trap door. Alternatively, or in addition to the configuration described above, the trap door can include a lip that extends from an upper peripheral surface of the trap door, such that the lip engages the upper surface of the grate to support the trap door within the grate opening.

A pump 12 is disposed within the container 2, preferably proximate a corner of the container and in general alignment with the location of the trap door 10. The pump 12 is secured within the container 2 via any suitable securing mechanism 14 (e.g., straps or ties that secure the pump to the side and bottom walls of the container). The pump can be of any suitable type and rated for any suitable flow capacity depending upon the particular environment in which the device is to be used. The pump and trap door are preferably configured to facilitate easy access to the pump for removal, maintenance and/or replacement of the pump after the fountain device has been installed in an underground location.

The pump includes a grounded electrical supply cord and is preferably configured for use with any standard outdoor wall receptacle (e.g., a 110V power source). The supply cord has suitable dimensions to permit the cord to extend through an aperture 8 in the grate 6 and to the wall receptacle. Alternatively, the pump can be powered by an internal power supply source disposed within the container (e.g., a battery) to alleviate the need for a power cord. When using an internal power supply source, a power switch can be provided at a suitable location external to the container to selectively control operation of the pump. Further, the device can be configured to include a wireless power supply controller (e.g., an infrared or RF remote).

The pump is preferably mounted on a step or mount 13 disposed on the bottom wall of the container, where the mount 13 has sufficient height dimensions (e.g., about 1 inch in height) to protect the pump from exposure to debris that may accumulate at the bottom of the container during operation of the device.

A discharge hose 16 made of any suitable material (e.g., PVC) and having any suitable cross-sectional dimensions (e.g., about 0.5 inch in diameter) extends between the outlet of the pump and an opening in a side wall surface of the support column 4. The hose 16 further extends into the hollow portion of the support column 4 to an opening 18 (e.g., a circular opening about 2 inches in diameter) disposed at a generally central location of the grate 6. The discharge hose 16 facilitates the delivery of water from the container 2, via the pump 12, to a decorative structure (e.g., a rock, sculpture, etc.) as described below. The hose 16 is connected to the pump outlet with a suitable hose adapter (e.g., an adjustable clamp) to provide a fluid tight seal at their junction. A valve (e.g., a PVC valve, not shown in figures) is located in the hose connection with the pump to provide a choke feature for the pump.

The fountain device can be installed in any number of suitable locations including, without limitation, outdoor environments such as lawns, gardens and other grounds (e.g., by partially or completely burying the fountain container underground), and as an accessory for a deck (e.g., installation of the fountain device with an elevated deck, where the fountain grate is substantially flush with the floor surface of the deck). In addition, the fountain device can be installed in indoor environments including, without limitation, within sun rooms, in reception areas for businesses, and in a variety of different public areas (e.g., shopping malls).

Figure 3:
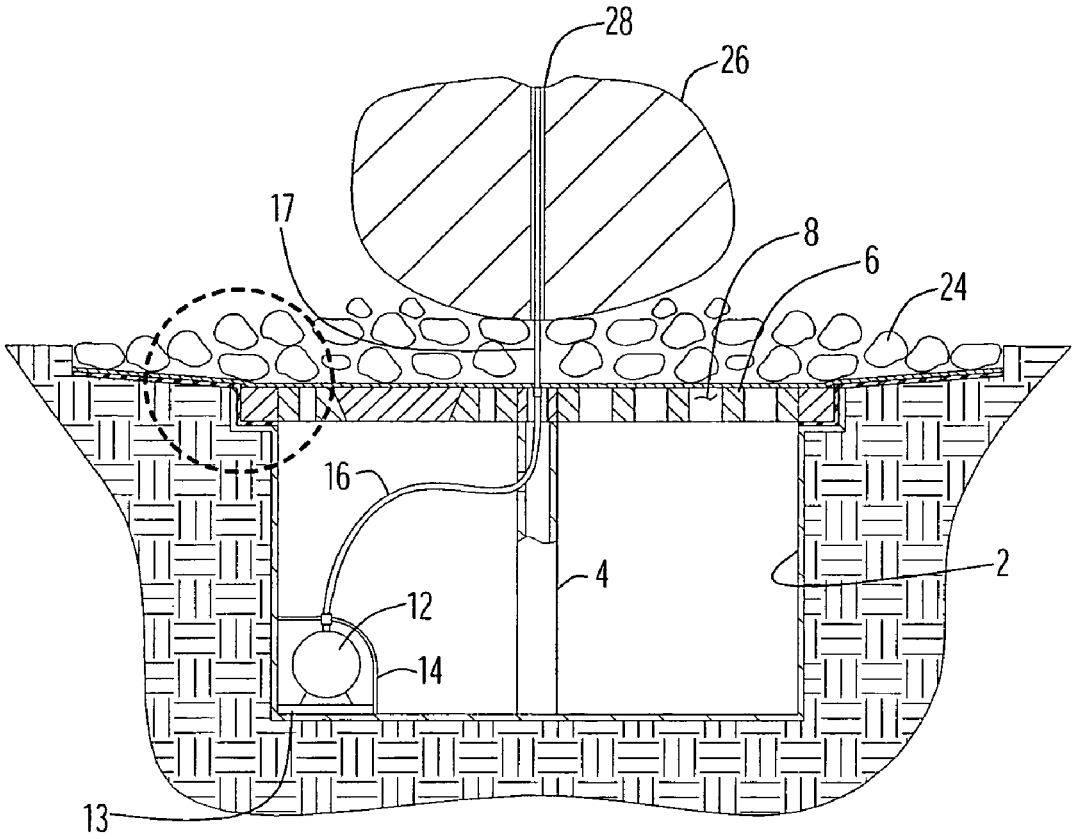
FIG. 3 is a side view in cross-section of the fountain device installed underground in an outdoor environment.

An exemplary embodiment for installation of the fountain device is described below and depicted in FIGS. 3 and 4. In this non-limiting embodiment, the fountain device is installed in an outdoor environment, where the container of the fountain device is embedded within the ground (e.g., in a garden). Referring to FIG. 3, the installer initially excavates a trench in the ground at a desired location where the container 2 is to be embedded. The container 2 is then embedded in the trench. The container can be partially or substantially completely embedded within the trench. The pump 12 is secured within the container 2 with the securing mechanism 14, and the discharge hose 16 is connected to the pump 12 and inserted through the opening in the support column to the central opening in the grate 6. The power cord of the pump 12 is long enough to extend through an opening near a side of the grate 6 in order to connect with a suitable power source (e.g., an outside wall outlet). Any loose soil that is filled in around the container can be compacted. Preferably, the depth of the trench is about the same or slightly larger in size than the container 2 such that the container is nearly flush or slightly inset from the ground surface when it rests in the trench.

Figure 4:
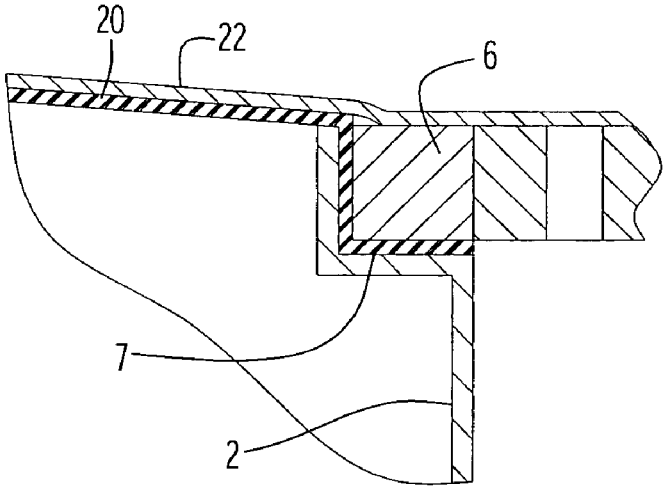
FIG. 4 is an enlarged view of a portion of the installed fountain device of FIG. 3.

Optionally, a flexible apron 20 (see FIG. 4) is placed around the periphery of the upper edges of the container 2 so as to engage the container lip 7 (as depicted in FIG. 4) prior to insertion of the grate 6 on the container lip 7. The apron can be constructed of HDPE or any other suitable material and have any suitable dimensions (e.g., 2-4 millimeter thickness) to facilitate cutting of the apron to a desired size during installation of the device. A flexible filter fabric 22 or other suitable filtering material is placed over the container 2 and portions of the ground surrounding the container 2. The filter fabric 22 covers the grate 6 and allows the placement of decorative stone, gravel, or any other suitable particulate material (indicated as reference numeral 24 in FIG. 3) over the container 2 and ground. The filter fabric 22 is also sufficiently coarse and has a suitable porosity to allow easy passage of water through the fabric without clogging, while being fine enough to prevent or minimize gravel, stones and other debris from entering through the grate into the container, where such debris could cause damage to the pump 12. Preferably, the ground surrounding the trench is graded with a slight pitch (e.g., about 1% slope) toward the grate 6 to allow water flowing from the fountain device to cycle back through the stones and into the container 2 during operation of the device.

A decorative structure 26 (e.g., a rock or stone) is placed on the particulate material 24 at an aligned location with the central opening of the grate 6. Preferably, the decorative structure is suitably dimensioned so as to fit within a foot print defined by the grate 6, which in turn facilitates recirculation of water or other fluid flowing from the decorative structure over the foot print of the grate for diffusion through the stones, gravel, etc. and back into the buried container 2. The structure 26 includes a passage or channel 28 extending through the structure to permit a conduit or hose 17 to extend from the grate through the channel. For example, when a large rock or stone is utilized as the decorative structure 26, the installer drills a hole of suitable dimensions through the stone to form the channel 28. The hose 17 may be constructed of any suitable material (e.g., PVC) and is connected to the pump discharge hose 16 via any suitable connecting fixtures (e.g., clamped bushings, couplings, etc.). Alternatively, the discharge hose 16 can have a sufficient length to extend through the central opening of the grate 6 and through a substantial portion of the channel 28 of the structure 26.

In operation, the container is initially filled with fluid such as water (e.g., by running water from a hose over the stones disposed directly over the container or, alternatively, by filling the container prior to covering the device with stones and/or other decorative material) to a selected level (e.g., about ¾ of the container volume). The pump 12 is turned on (e.g., by plugging the power cord into a wall outlet and/or engaging a power switch associated with the pump), and water is directed through the pump and into the discharge hose 16, where the water is then directed into hose 17 and through the channel 28 of the structure 26. The pumped water flows through a channel outlet at the top of the structure 26, flowing over the structure 26 and onto the stones 24. Water then flows through the stones, where the water is filtered by passing through the filter fabric 22, into the apertures 8 in the grate 6, and back into the container 2. Thus, the fountain device 1 provides an aesthetically pleasing fountain design that is easy to install and operate. If the pump 12 needs maintenance work or replacement, the stones and/or other decorative materials can be removed to expose the trap door 10 of the grate 6. The trap door allows access to the pump, allowing the pump to be removed from the container, without the requirement of removing the entire grate 6 from the container.

The fountain device is further provided in the form of a kit to further ease installation of the device. The kit includes the container 2 with support column 4, the pump 12 and discharge hose 16 (e.g., coiled in the container), and the grate 6. Optionally, the kit can be provided with the internal components partially or fully assembled. For example, the kit can be provided with the pump 12 already secured in the container in a manner as described above, and the discharge hose 16 already assembled (i.e., connected to the pump and extending into the support column). The support column 4 can also be detachably or permanently secured in the container 2. Alternatively, as noted above, the kit can be provided without a support column depending upon the particular use for the device. The kit can further include additional materials, such as the apron and a suitable amount of filter fabric, as well as an assembly instruction manual (e.g., a written manual and/or video tape providing assembly and/or installation instructions) and/or any other suitable materials (e.g., brackets, additional pump and hose clamps, ties and/or other securing members, additional pipe fittings and hoses to easily adapt additional decorative structures to the fountain device, electrical cord for pump rolled and taped or strapped to grate, etc.). All of the kit components can be packaged in the container with the grate covering the container. The kit can further include a decorative structure for use with the fountain device (e.g., a hollow statue or other decorative structure that is configured for connection with the discharge hose of the pump).

Having described preferred embodiments of a new and improved fountain device, it is believed that other modifications, variations and changes will be suggested to those skilled in the art in view of the teachings set forth herein. It is therefore to be understood that all such variations, modifications and changes are believed to fall within the scope of the present invention as defined by the appended claims and equivalents thereof. Although specific terms are employed herein, they are used in a generic and descriptive sense only and not for purposes of limitation.

What is claimed is:

1. A fountain device comprising:

a container including a reservoir to hold and retain circulating fluid within the fountain device, the container including an opening and a lip extending around at least a peripheral portion of the opening;

a pump securable within the container;

a cover configured to encompass the opening and engage the lip of the container when the cover is installed on the container, wherein the cover includes a removable door configured to permit removal of the pump from the container and a plurality of apertures that facilitate passage of fluid through the cover to the reservoir of the container;

a discharge hose securable to an outlet of the pump and extendable to an outlet of the container; and a support structure comprising at least one support column configured to extend and engage with both a lower surface of the container within the reservoir and the cover so as to provide support for the cover when forces are applied to the cover.

2. The fountain device of claim 1, wherein the at least one support column is configured to provide support for and prevent deformation of the cover when the cover bears a weight of 2000 pounds or greater.

3. The fountain device of claim 2, wherein the at least one support column includes a hollow section configured to receive a portion of the discharge hose that connects with the outlet of the container.

4. The fountain device of claim 1, further comprising:

a mount disposed on a lower wall of the container and configured to support the pump within the reservoir at a selected distance from the lower wall of the container so as to prevent accumulated debris within the reservoir from entering the pump.

5. The fountain device of claim 1, further comprising:

a filter material suitably dimensioned to fit over the cover when the cover is installed on the lip of the container, wherein the filter material has a suitable porosity to permit passage of fluid through the filter material while preventing solid debris of selected dimensions from passing through the filter material.

6. The fountain device of claim 1, further comprising:

an apron comprising a flexible material and suitably dimensioned to facilitate placement of the apron around the periphery of the container when the container is installed at a selected location, wherein a portion of the apron is configured to extend between the lip of the container and the cover.

7. The fountain device of claim 1, further comprising:

a decorative structure including a channel extending through a portion of the decorative structure and configured such that, during use of the fountain device, the channel of the decorative structure is in fluid communication with the discharge hose.

8. A fountain device kit for forming a fountain device, the fountain device kit comprising:

a container including a reservoir to hold and retain circulating fluid within the fountain device, the container including an opening and a lip extending around at least a peripheral portion of the opening;

a pump secured within the container;

a cover configured to encompass the opening and engage the lip of the container when the cover is installed on the container, wherein the cover includes a removable door configured to permit removal of the pump from the container and a plurality of apertures that facilitate passage of fluid through the cover to the reservoir of the container;

a support structure comprising at least one support column configured to extend and engage with both a lower surface of the container within the reservoir and the cover so as to provide support for the cover when forces are applied to the cover; and a discharge hose secured to an outlet of the pump and extending to an outlet of the container.

9. A method of using a fountain device comprising:

embedding at least a portion of a container within a support structure for the container, wherein the container includes a reservoir and is configured to hold and retain fluid circulating within the fountain device;

securing a pump within the container;

securing a discharge hose to an outlet of the pump and an outlet of the container;

installing a support structure comprising at least one support column within the reservoir of the container such that a lower end of the at least one support column engages a lower surface of the container within the reservoir; and installing a cover over an opening of the container by engaging the cover with a lip extending around at least a peripheral portion of the container, wherein the cover includes a removable door configured to permit removal of the pump from the container and a plurality of apertures that facilitate passage of fluid through the cover to the reservoir of the container; and the at least one support column engages the cover so as to provide support for the cover when forces are applied to the cover.

10. The method of claim 9, wherein the at least one support column provides support for and prevents deformation of the cover when the cover bears a weight of 2000 pounds or greater.

11. The method of claim 10, wherein the at least one support column includes a hollow section configured to receive a portion of the discharge hose that connects with the outlet of the container.

12. The method of claim 10, wherein the pump is supported on a mount at a selected distance from the lower wall of the container so as to prevent accumulated debris within the reservoir from entering the pump.

13. The method of claim 10, further comprising:

placing a filter material over the cover, wherein the filter material includes a suitable porosity to permit passage of fluid through the filter material while preventing solid debris of selected dimensions from passing through the filter material.

14. The method of claim 13, further comprising:

placing an apron comprising a flexible material between the filter material and the cover, wherein the apron extends around the periphery of the container and a portion of the apron is configured to extend between the lip of the container and the cover.

15. The method of claim 13, wherein the container is substantially completely embedded under a ground surface, and the method further comprises:

covering the filter material with a particulate material; and placing a decorative structure on at least a portion of the particulate material that is situated over the cover, wherein the decorative structure includes a channel extending through a portion of the decorative structure and that is in fluid communication with the discharge hose.

16. The method of claim 15, further comprising:

constructing a surface portion of the ground surface surrounding the container at a selected pitch such that the surface portion slopes in a downward direction toward the cover and the embedded container.

17. The method of claim 16, wherein the ground surface in which the container is embedded comprises a trench formed within an outdoor ground surface.

18. A fountain device comprising:

a container including a reservoir to hold and retain circulating fluid within the fountain device, the container including an opening and a lip extending around at least a peripheral portion of the opening;

a pump securable within the container;

a cover configured to encompass the opening and engage the lip of the container when the cover is installed on the container, wherein the cover includes a plurality of apertures that facilitate passage of fluid through the cover to the reservoir of the container;

a discharge hose securable to an outlet of the pump and extending to an outlet of the container; and a decorative structure configured to be placed over so as to rest on the cover, wherein the decorative structure includes a channel extending through a portion of the decorative structure and is further configured to engage so as to be in fluid communication with the discharge hose such that fluid flowing through the discharge hose flows through the channel so as to emerge from the decorative structure for circulation through the apertures in the cover and into the reservoir of the container during operation of the fountain device.

* * * * *